US010493369B2

(12) United States Patent
Schmid

(10) Patent No.: US 10,493,369 B2
(45) Date of Patent: Dec. 3, 2019

(54) TOY VEHICLE TRACK SET

(71) Applicant: MATTEL, INC., El Segundo, CA (US)

(72) Inventor: Paul Schmid, Ojai, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 15/707,101

(22) Filed: Sep. 18, 2017

(65) Prior Publication Data

US 2018/0078869 A1 Mar. 22, 2018

Related U.S. Application Data

(60) Provisional application No. 62/396,718, filed on Sep. 19, 2016.

(51) Int. Cl.

| | |
|---|---|
| ***A63H 18/06*** | (2006.01) |
| ***A63H 18/08*** | (2006.01) |
| ***A63H 18/02*** | (2006.01) |

(52) U.S. Cl.

CPC ..... *A63H 18/08* (2013.01); *A63H 18/023* (2013.01); *A63H 18/06* (2013.01)

(58) Field of Classification Search

CPC ..... A63H 18/08; A63H 18/023; A63H 18/06
USPC ..... 446/444, 429
See application file for complete search history.

(56) References Cited

U.S. PATENT DOCUMENTS

| | | | | |
|---|---|---|---|---|
| 3,600,849 | A | 8/1971 | Faller | |
| 4,312,149 | A | 1/1982 | Iwao | |
| 4,508,517 | A | 4/1985 | Kulesza | |
| 5,174,569 | A | 12/1992 | Ngai | |
| 5,370,571 | A | 12/1994 | Bosch | |
| 7,914,361 | B1 | 3/2011 | Morris | |
| 8,342,903 | B2 | 1/2013 | O'Connor | |
| 8,567,690 | B2 | 10/2013 | De La Torre | |
| 8,747,180 | B2 | 6/2014 | O'Connor | |
| 2005/0191940 | A1 | 9/2005 | Sheltman | |
| 2005/0287915 | A1 | 12/2005 | Sheltman | |
| 2009/0117821 | A1 | 5/2009 | Ogihara | |
| 2010/0112896 | A1 | 5/2010 | Chang | |
| 2011/0124265 | A1* | 5/2011 | O'Connor | A63H 18/02 446/429 |
| 2012/0264350 | A1 | 10/2012 | Dstendorff | |
| 2014/0070015 | A1* | 3/2014 | Matthes | A63H 18/06 238/10 A |

FOREIGN PATENT DOCUMENTS

| | | | |
|---|---|---|---|
| WO | 1999017855 | A1 | 4/1994 |

* cited by examiner

*Primary Examiner* — Vishu K Mendiratta

(74) *Attorney, Agent, or Firm* — Edell, Shapiro & Finnan, LLC

(57) ABSTRACT

A toy vehicle track set according to present invention includes a first track portion, a second track portion, a base to which the first and second track portions are coupled, and a carriage. At least one of the first track portion and the second track portion is repositionable about the base with respect to the other track portion and the carriage is movably coupled to the base. The carriage is positionable proximate to the first track portion, the second track portion, or both the first and second track portions.

19 Claims, 7 Drawing Sheets

TOY VEHICLE TRACK SET

CROSS-REFERENCE TO RELATED APPLICATION

This application claims priority to and the benefit of U.S. Provisional Patent Application No. 62/396,718, filed Sep. 19, 2016, entitled "Toy Vehicle Track Set," the entire disclosure of which is incorporated herein by reference in its entirety.

FIELD OF THE INVENTION

The present invention relates to a toy vehicle track set, and in particular, to a toy vehicle track set that is adjustable and reconfigurable to vary the play options of the track set.

BACKGROUND OF THE INVENTION

Conventional toy vehicle track sets include a section of track along which a toy vehicle can travel. However, the creativity of play using a straight section of toy vehicle track is limited.

A need exists for a toy vehicle track set that allows a user to further express their creativity by allowing the user to create various arrangements and configurations for play.

SUMMARY OF THE INVENTION

A toy vehicle track set according to the present invention includes one or more track sections, and a support to which at least one the track sections is coupled. The support includes an elongate member and a base. The elongate member is mounted on the base and includes at least one coupler movably coupled thereto. The coupler is sized so that a track section can slide onto the coupler.

A toy vehicle track set according to the present invention also includes a first track portion, the first track portion having a longitudinal axis, and a second track portion having its own longitudinal axis.

A toy vehicle track set according to the present invention may also include a base having a first base portion and a second base portion, the first base portion being coupled to the first track portion, and the second base portion being coupled to the second track portion.

The second base portion of a toy vehicle track set according to the present invention may be positionable in and movable between a first position a second position.

A toy vehicle track set according to the present invention may also include a carriage defining receptacle for the toy vehicle, the carriage including a housing defining the receptacle and an arm coupled to the housing, the carriage being movable between a first position proximate to the first base portion and a second position proximate to the second base portion, the base including a biasing member biasing the carriage from its first position to its second position.

A toy vehicle track set according to the present invention may also include a release mechanism to release the carriage allowing the biasing member to move the carriage between the first position proximate to the first base portion and the second position proximate to the second base portion.

The first track portion of a toy vehicle track set according to the present invention may include a first longitudinal axis and the second track portion may have a second longitudinal axis, the second track portion being movable relative to the first track portion so that the second longitudinal axis is position at an angle in a range of 0° to 180° with respect to the first longitudinal axis.

BRIEF DESCRIPTION OF THE DRAWINGS

Like reference numerals have been used to identify like elements throughout this disclosure.

DETAILED DESCRIPTION OF THE INVENTION

A toy vehicle track set according to the present invention includes a first track portion, a second track portion, a base, and a carriage. In one embodiment the first track portion and the second track portion are substantially similar. Each of the track portions is coupled to the base. The base supports the carriage for movement between a first position (i.e., a first carriage position) proximate to the first track portion and a second position (i.e., a second carriage position) proximate to the second track portion.

In one embodiment the base includes a first base portion with an end to which the first track portion is coupled and a second base portion with its own end to which the second track portion is coupled. The first base portion is pivotally coupled to the second base portion via a coupler, such as a pin or axle. The pin or axle defines an axis of rotation for the second base portion relative to the first base portion. As a result, the first track portion and/or second track portion can be moved relative to the other track portion by rotating the base portion to which a moving track portion is coupled.

In one embodiment of the toy vehicle track set according to the present invention, the toy vehicle track set includes a carriage that moves between a first carriage position and a second carriage position. The carriage is rotatably mounted to the base, the first carriage position is proximate to the first track portion, and the second carriage position is proximate to the second track portion. The carriage is configured to receive a toy vehicle therein. As a result, a toy vehicle can travel along the first track portion into the carriage when the carriage is located in the first carriage position (via the first base portion). Then, the carriage may pivot about its axis of rotation to the second carriage position so that the toy vehicle can exit the carriage onto the second track portion (via the second base portion).

In one embodiment of the toy vehicle track set according to the present invention, the base portions can move relative to each other. This allows the first and second track portions to be positioned at any angle relative to one another between a parallel position and a completely collinear position (i.e., any angle between 0° and 180° relative to one another).

Figure 1:
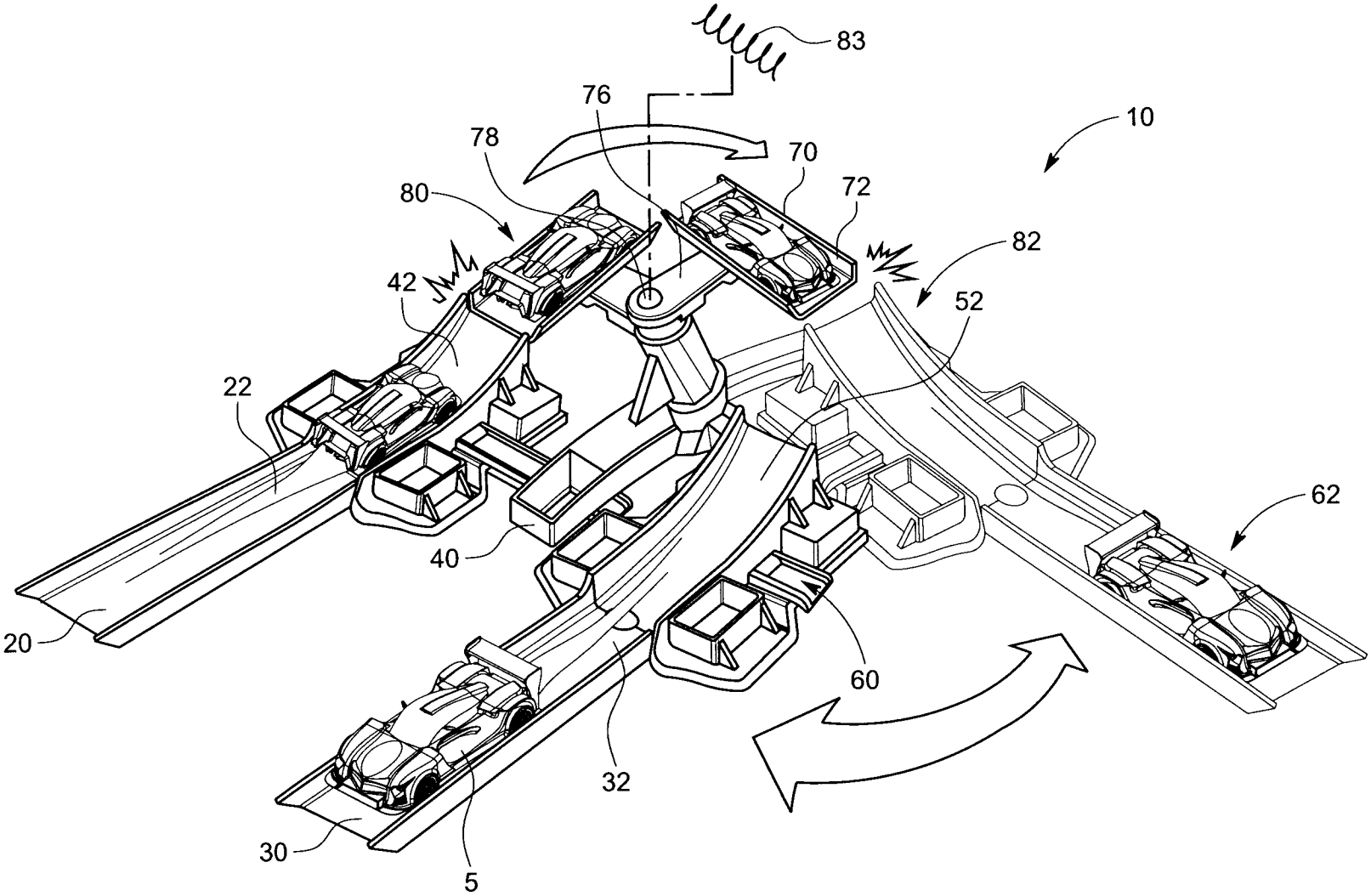
FIG. 1 illustrates a perspective view of a toy vehicle track set according to an embodiment of the present invention.

In one embodiment of the toy vehicle track set according to the present invention, the toy vehicle track set includes a first track portion a second track portion, a base, and carriage. Referring to FIG. 1, the present invention includes a toy vehicle track set 10 that can be used with one or more toy vehicles 5. Toy vehicle track set 10 includes a first track portion 20 and a second track portion 30. First track portion 20 has an end 22 and a longitudinal axis 24 (see FIG. 2). Similarly, second track portion 30 has and end 32 and a longitudinal axis 34 (see FIG. 2).

In this particular embodiment, the toy vehicle track set 10 includes a base 40 to which each of the track portions 20, 30 is coupled. Base 40 includes a first base portion 42 and a second base portion 52. First base portion 42 has an end 44 to which the end 22 of the first track portion 20 is coupled (see FIG. 2). In one implementation of the present invention, the first base portion 42 includes a tongue (not shown) that slides into a corresponding groove or slot on bottom of the end 22 of the first track portion 20. The first base portion 42 includes a ramp portion with a lower end and an upper end.

Figure 2:
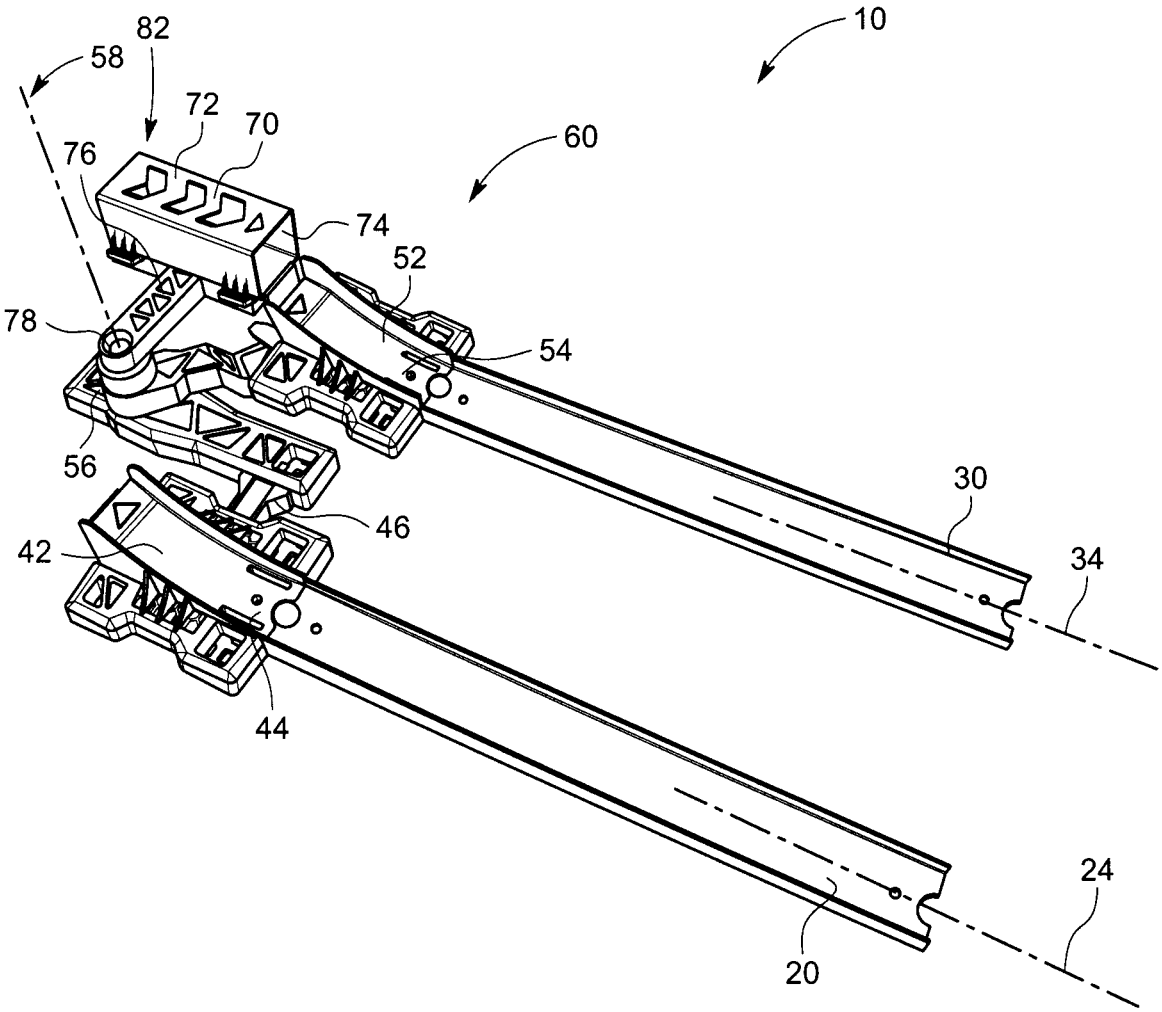
FIG. 2 illustrates a perspective view of a toy vehicle track set according to another embodiment of the present invention.

Similarly, second base portion 52 includes an end 54 to which the end 32 of the second track portion 30 is coupled (see FIG. 2). The second base portion 52 includes a tongue (not shown) that slides into a groove or slot on the bottom of the end 32 of the second track portion 30. The second base portion 52 includes a ramp portion with a lower end and an upper end. In one implementation of the present invention, see FIG. 2 for example, the first base portion 42 includes a coupling portion 46 for coupling to the base 40. Similarly, the second base portion 52 includes a coupling portion 56 for coupling to the base 40.

In one alternatively embodiment, the second base portion 52 is pivotally coupled to the first base portion 42. In another embodiment, the first base portion 42 is stationary and the second base portion 52 is movable relative to the first base portion. In that embodiment, the first base portion 42 can be referred to as a stationary base portion 42 and the second base portion 52 can be referred to as a movable or repositionable base portion 52.

In one embodiment, the first base portion 42 and the second base portion 52 are rotatably or pivotably coupled to each other. In particular, the second base portion 52 is rotatable about an axis 58 that is defined by a pin, axle or post. The pin, axle, or post can be either coupled to or integrally formed with the first base portion 42. The second base portion 52 can move relative to the first base portion 42 between a first position 60 and a second position 62. The first position 60 is illustrated in FIGS. 1 and 2, and the second position 62 is illustrated in FIG. 1 (in shadow) and FIG. 3.

Also shown in FIG. 1 is a carriage 70. Carriage 70 includes a housing 72 that defines a receptacle 74 (see FIG. 2) in which a toy vehicle 5 may be placed. Coupled to the housing 72 is an arm 76 that has a distal end 78 that is mounted to the base portion 40 for rotation of the arm 76 with respect to the base 40. In various embodiments, the arm 76 may be coupled to the post that is coupled to or integrally formed with the first base portion.

The arm 76 is movable between a first position 80 and a second position 82. The carriage 70 travels from a first position 80 proximate to the first base portion 42 to second position 82 adjacent the second base portion 52. In one implementation of the present invention, the base 40 includes a biasing member, such as a torsion spring 83, that biases the carriage 70 from its first position 80 to its second position 82. The carriage 70 may be retained in its first position 80, in which it is proximate to the first base portion 42, by a latch. When a toy vehicle 5 enters the carriage 70, the latch is actuated (see the discussion of FIGS. 4-7 below as an example) to release the carriage 70 for movement, thereby allowing the torsion spring to cause the carriage 70 to move from the first position 80 to its second position 82. When the carriage 70 moves to its second position 82, the toy vehicle 5 is released from the carriage housing 72 and can then travel down the second base portion 52.

Referring to FIG. 2, another embodiment of a toy vehicle track set 10 in accordance with the present invention is illustrated. In this embodiment, the toy vehicle track set 10 utilizes the same reference numerals that were used to identify like elements illustrated in FIG. 1. As shown, the first track portion 20 includes a longitudinal axis 24 and the second track portion 30 has its own longitudinal axis 34. In the position 60 illustrated in FIG. 2, the first track portion 20 and the second track portion 30 are parallel to and offset from each other, as illustrated by the longitudinal axes 24, and 34. That is, in FIG. 2, the two track portions 20, 30 are parallel to each other and the longitudinal axes 24, 34 are angularly spaced by approximately 180 degrees (at least because the direction of travel for a toy vehicle rotates approximately 180 degrees). The orientation of the track portions 20, 30 relative to each other is determined by the positions of the first base portion 42 and the second base portion 52 relative to each other.

Still referring to FIG. 2, the first base portion 42 includes a ramp along which the toy vehicle 5 can travel into the carriage 70. Similarly the second base portion 52 includes a ramp down which toy vehicle 5 exiting the carriage 70 travels. The axis 58 about which the second base portion 52 rotates relative to the first base portion 42 is illustrated in FIG. 2. Axis 58 is also the axis about which the end 78 of carriage arm 76 rotates so that the carriage 70 rotates between a position 80 proximate the first base portion 42 and a position 82 proximate the second base portion 52. That is, in at least some embodiments, the second base portion 52 and the carriage 70 rotate about the same vertical axis.

Figure 3:
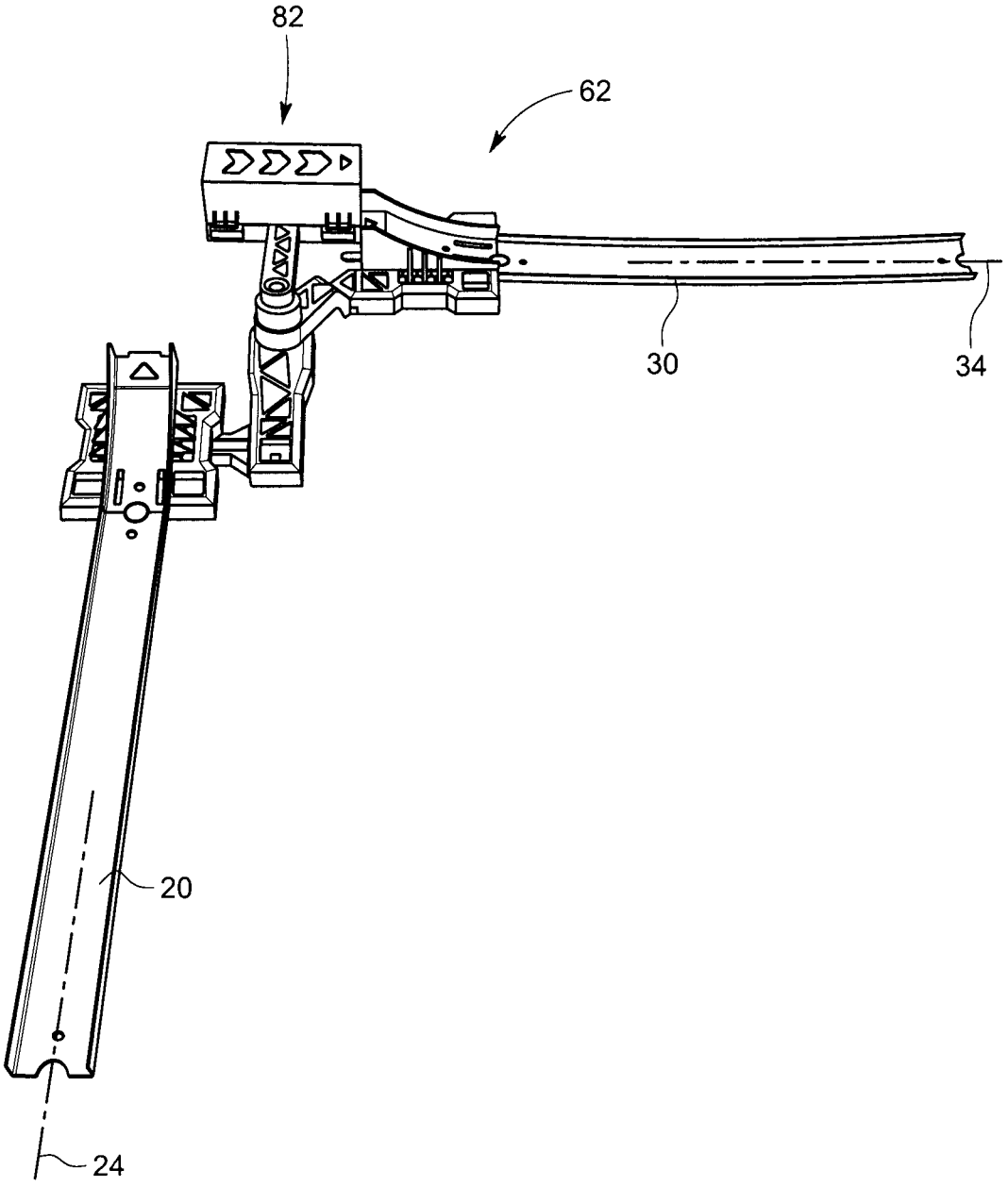
FIG. 3 illustrates a perspective view of the toy vehicle track set of FIG. 2 reconfigured to a second position.

Referring to FIG. 3, the track portions 20, 30 are reoriented so that their respective longitudinal axes 24, 34 are angularly spaced 90 degrees apart. In another orientation, not shown, the track portions 20, 30 are arranged so that their longitudinal axes 24, 34 are collinear and extend in substantially the same direction. In such an arrangement, the toy vehicle 5 travels up the first base portion 42, through the carriage 70, and straight down the second base portion 52. That is, when track portions 20 and 30 are collinear, the carriage 70 essentially serves as a bridge between upper ends of the ramps included on base portion 42 and base portion 52 so that base portion 42, base portion 52, and carriage 70 form a substantially continuous path (which may or may not include small gaps between the various components that the toy vehicle can easily traverse).

Figure 4:
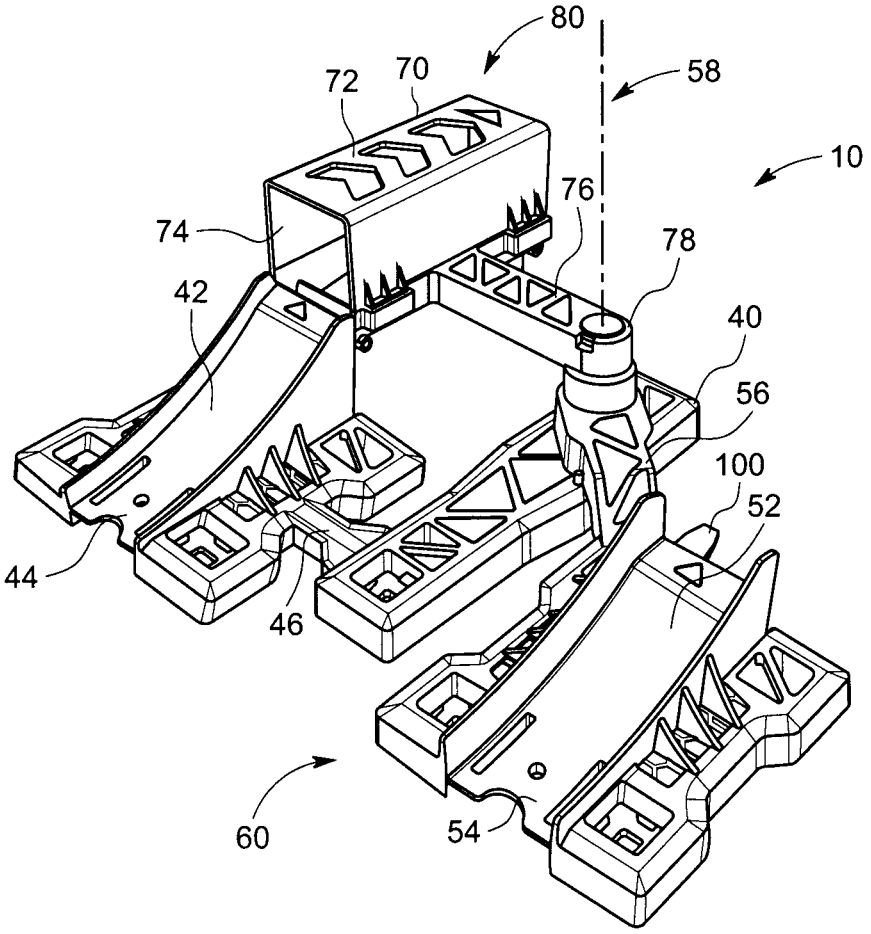
FIG. 4 illustrates a front perspective view of the toy vehicle track set according to another embodiment of the present invention.
Figure 5:
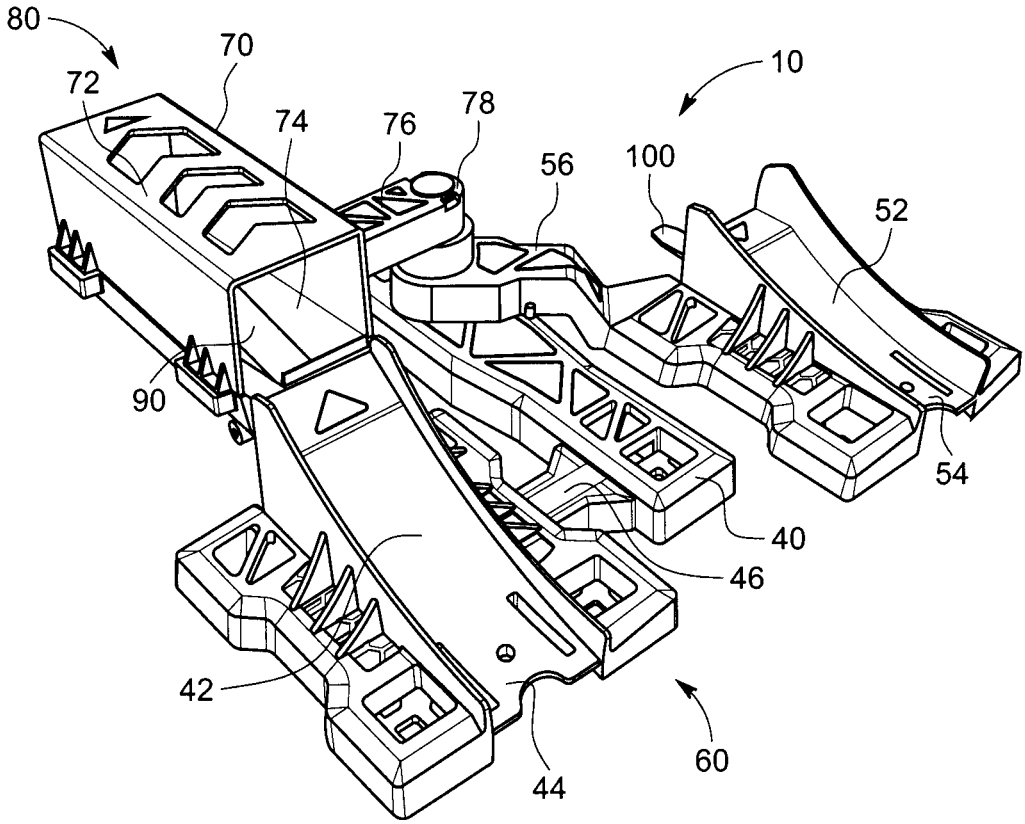
FIG. 5 illustrates another perspective view of the toy vehicle track set of FIG. 4.
Figure 6:
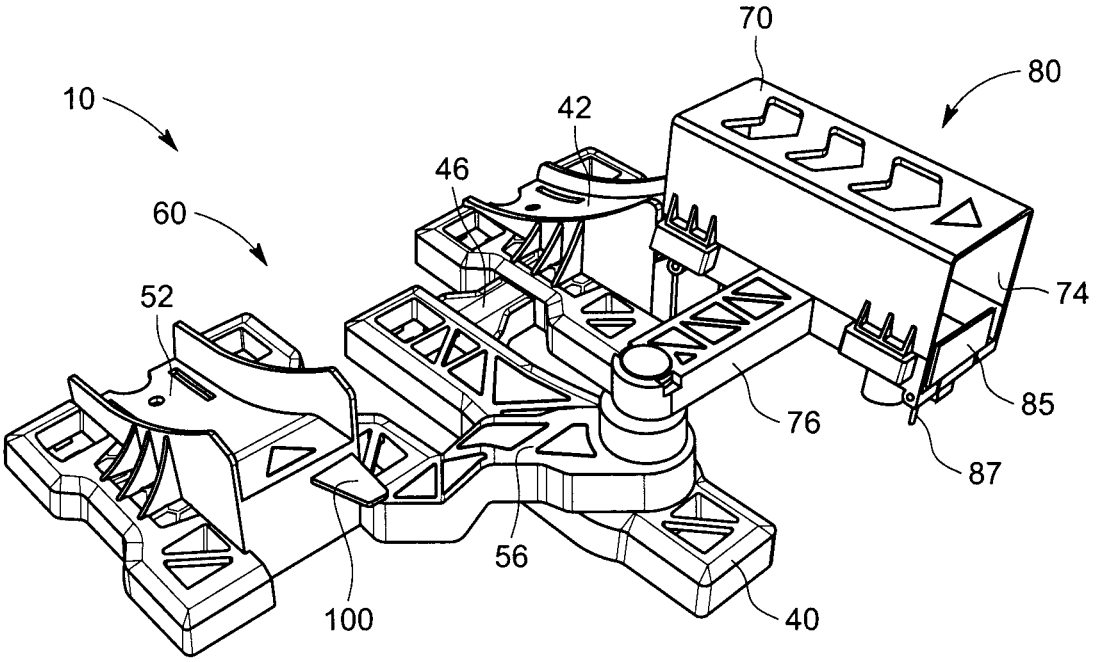
FIG. 6 illustrates a rear perspective view of the toy vehicle track set of FIG. 4.
Figure 7:
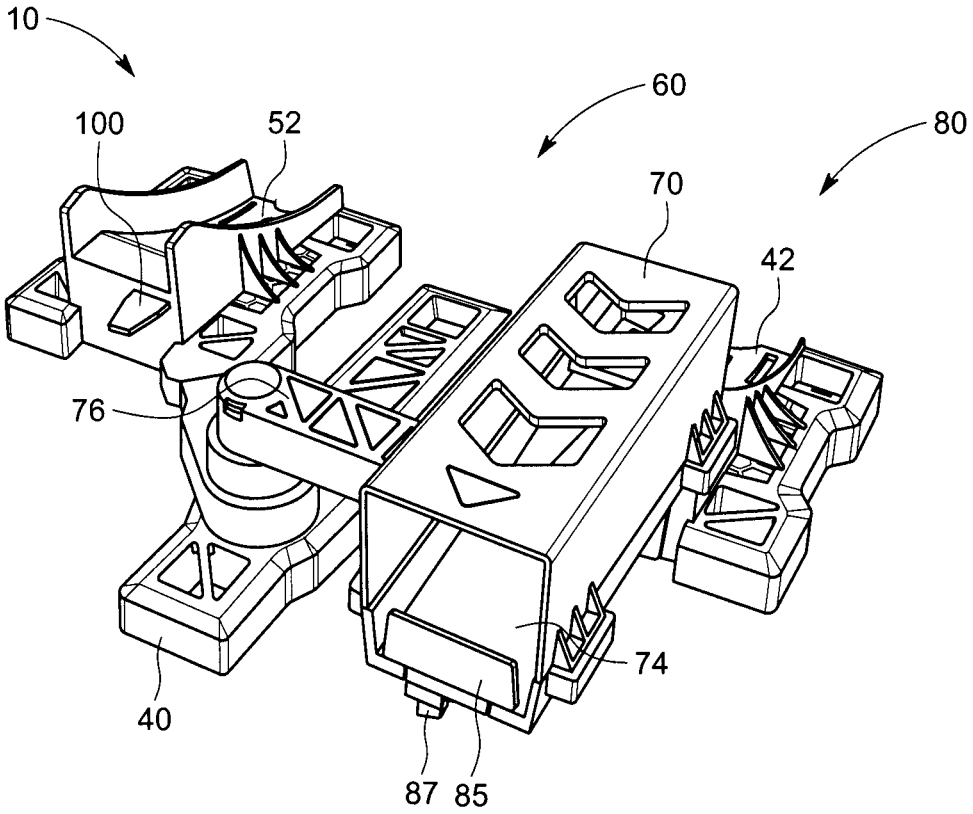
FIG. 7 illustrates another perspective view of the toy vehicle track set of FIG. 4.

Referring to FIGS. 4-7, another embodiment of a toy vehicle track set 10 in accordance with the present invention is illustrated. In this embodiment, the toy vehicle track set 10 utilizes the same reference numerals that were used to identify like elements illustrated in FIGS. 1-3. FIG. 4 illustrates a front perspective view of the toy vehicle track set 10 according to another embodiment of the present invention (with the track portions 20, 30 omitted for clarity). FIG. 5 illustrates a close-up front perspective view of the toy vehicle track set of FIG. 4, FIG. 6 illustrates a rear perspective view of the toy vehicle track set of FIG. 4, and FIG. 7 illustrates a close-up rear perspective view of the toy vehicle track set of FIG. 4.

In the embodiment illustrated in FIGS. 4-7, base 40 includes a first base portion 42 and a second base portion 52.

First base portion 42 has an end 44 to which the end 22 of the first track portion 20 is coupled (see FIG. 2 and its description above). Similarly, second base portion 52 includes an end 54 to which the end 32 of the second track portion 30 is coupled (also see FIG. 2 and its description above). The first base portion 42 includes a coupling portion 46 for coupling to the base 40. Similarly, the second base portion 52 includes a coupling portion 56 for coupling to the base 40.

The first base portion 42 and the second base portion 52 are rotatably coupled to each other. In particular, the second base portion 52 rotatable about an axis 58 that is defined by a pin or axle (see FIG. 4). The second base portion 52 can move relative to the first base portion 42 between a first position 60 and a second position 62. The first position 60 is illustrated in FIGS. 1, 2 and 4-7, and the second position 62 is illustrated in FIG. 1 (in shadow) and FIG. 3.

Carriage 70 includes a housing 72 that defines a receptacle 74 in which a toy vehicle may be placed. Coupled to the housing 72 is an arm 76 that has a distal end 78 that is mounted to the base 40 for rotation of the arm 76 with respect to the base 40. The arm 76 is movable between a first position 80 (shown in FIGS. 4-7) and a second position 82 (see FIGS. 2 and 3, for example). The carriage 70 travels from the first position 80 proximate to the first base portion 42 to the second position 82 adjacent the second base portion 52 (regardless of the position of the second base portion, as is shown, for example, in FIGS. 2 and 3). Notably, when the carriage 70 is in the first position 80, the first track portion 20, the first base portion 42, and the housing 72 (and/or the carriage 70) provide a continuous pathway and when the carriage 70 is in the second position 82, the second track portion 30, the second base portion 52, and the housing 72 (and/or the carriage 70) provide a continuous pathway.

In the embodiment shown in FIGS. 4-7, the base 40 includes a biasing member (not shown), such as a torsion spring, that biases the carriage 70 from its first position 80 to its second position 82. The carriage 70 is retained in its first position 80, in which it is proximate to the first base portion 42, by a latch (not shown). Note that the carriage 70 also includes a door 85 at its end to prevent the toy vehicle from prematurely exiting the housing 72 of the carriage 70. When a toy vehicle enters the carriage 70, the latch is actuated by the weight of the toy vehicle being received upon latch release actuator 90 (see FIG. 5), which is positioned within the receptacle 74 of the carriage 70. Actuation of the latch (by the latch release actuator 90) releases the carriage 70 for movement, thereby allowing the torsion spring to move the carriage 70 from the first position 80 to its second position 82 (due to its biasing). That being said, in other embodiments, any type of release mechanism may be utilized for the carriage 70 without departing from the scope and spirit of the present invention.

When the carriage 70 moves to its second position 82, the toy vehicle is released from the carriage housing 72 and can then travel down the second base portion 52. In the embodiment illustrated in FIGS. 4-7, with specific reference to FIGS. 6 and 7, when the carriage 70 moves to its second position 82, alignment/door release tab 100 on the second base portion 52 contacts door tab 87 on the door 85, causing the door 85 to pivot from its closed position, which is illustrated in FIGS. 6 and 7, to its open position, which is illustrated in FIG. 2, to release the toy vehicle from the carriage housing 72 so it can then travel down the second base portion 52 and onto the attached track portion.

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" is used herein to describe an example or illustration. Any embodiment described herein as exemplary is not to be construed as a preferred or advantageous embodiment, but rather as one example or illustration of a possible embodiment of the invention.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. A track set for a toy vehicle, comprising:

a first track portion having a longitudinal axis;

a second track portion having a longitudinal axis;

a base having a first base portion that includes a post and a second base portion pivotally coupled to the post of the first base portion and movable about a rotation axis, the first base portion being fixedly coupled to the first track portion, and the second base portion being fixedly coupled to the second track portion, the second base portion movable relative to the first base portion between a first position and a second position; and a carriage including an arm pivotally coupled to the post of the first base portion and a housing coupled to the arm, the housing defining a receptacle for the toy vehicle, the carriage being movably coupled to the base for movement about the rotation axis between a first carriage position proximate to the first base portion and a second carriage position proximate to the second base portion, the second base portion and the carriage each being movable independently from each other, and the base including a biasing member biasing the carriage from its first carriage position to its second carriage position.

2. The track set according to claim 1, wherein the second track portion is movable relative to the first track portion so that the longitudinal axes of the first and second track portions are substantially collinear when the second base portion is in the first position and the longitudinal axes of the first and second track portions are substantially parallel and offset from each other when the second base portion is in the second position.

3. The track set according to claim 1, wherein the second base portion is pivotally coupled to the first base portion.

4. The track set according to claim 1, wherein each of the first base portion and the second base portion further comprises:

a ramp along which the toy vehicle can travel.

5. The track set according to claim 4, wherein each of the ramps includes a lower end and an upper end.

6. The track set according to claim 5, wherein the housing is proximate to the upper end of the first base portion ramp when the carriage is in the first carriage position and the housing is proximate to the upper end of the second base portion ramp when the carriage is in the second carriage position.

7. The track set according to claim 6, wherein the housing further comprises:

an internal surface, wherein the toy vehicle can travel up the first base portion ramp and into the carriage along the internal surface when the carriage is in the first carriage position, and the toy vehicle can travel along the internal surface and down the second base portion ramp when the carriage is in the second carriage position.

8. The track set according to claim 6, wherein when the second base portion is in the first position, the carriage housing is positioned proximate to the upper end of the first base portion ramp and to the upper end of the second base portion ramp.

9. The track set according to claim 6, wherein when the second base portion is in the first position, the first base portion ramp is substantially collinear with the second base portion ramp.

10. A track set for a toy vehicle, comprising:

a first track portion;

a second track portion;

a base having a stationary base portion and a movable base portion coupled to the stationary base portion, the first track portion being fixedly coupled to the stationary base portion, and the second track portion being fixedly coupled to the movable base portion; and a carriage including an arm and a housing coupled to the arm, the housing defining a receptacle for a toy vehicle, the carriage being movably coupled to the stationary base portion, the carriage being positionable in a first position proximate to the stationary base portion and a second position proximate to the movable base portion, the base including a biasing member biasing the carriage from the first position to the second position;

wherein the movable base portion is repositionable between a first base position in which the movable base portion aligns the second track portion with the first track portion and a second base position in which the movable base portion positions the second track portion parallel to and offset from the first track portion and wherein the movable base portion and the carriage are each movable independently from each other.

11. The track set according to claim 10, wherein the carriage travels between the stationary base portion and the movable base portion regardless of how the movable base portion is positioned relative to the stationary base portion.

12. The track set according to claim 10, wherein the carriage further comprises:

a door that is actuated when the carriage reaches the second position, thereby allowing the toy vehicle to exit the carriage.

13. The track set according to claim 10, wherein the second track portion is movable relative to the first track portion so that the first track portion and the second track portion are substantially collinear when the movable base portion is in the first base position and the first track portion and the second track portion are substantially parallel and offset from each other when the movable base portion is in the second base position.

14. The track set according to claim 10, wherein:

the stationary base portion further comprises a stationary base portion ramp with an upper end and a lower end; and the movable base portion further comprises a movable base portion ramp with an upper end and a lower end, the housing being disposed proximate to the upper end of the stationary base portion ramp when in the first position, and the housing being disposed proximate to the upper end of the movable base portion ramp when in the second position.

15. The track set according to claim 10, wherein the first track portion, the stationary base portion, and the housing provide a continuous pathway when the carriage is in the first position, and the second track portion, the movable base portion, and the housing provide a continuous pathway when the carriage is in the second position.

16. A track set for a toy vehicle, comprising:

a first track portion;

a second track portion;

a base having a first base portion and a second base portion that is repositionable relative to the first base portion, the first track portion being fixedly coupled to the first base portion, and the second track portion being fixedly coupled to the second base portion; and a housing defining a receptacle for the toy vehicle, the housing being pivotally coupled to the base and movable between a first position proximate to the first base portion and a second position proximate to the second base portion, wherein the second base portion is repositionable relative to the first base portion between a plurality of positions, including an aligned position in which longitudinal axes of the first track portion and the second track portion are collinear and a parallel position in which the longitudinal axes of the first track portion and the second track portions are parallel to and offset from each other.

17. The track set according to claim 16, wherein the first track portion, the first base portion, and the housing provide a continuous pathway when the housing is in the first position, and the second track portion, the second base portion, and the housing provide a continuous pathway when the housing is in the second position.

18. The track set according to claim 16, wherein each of the first base portion and the second base portion includes a ramp with a lower end and an upper end, the housing being disposed proximate to the upper end of the first base portion ramp when in the first position, and the housing being disposed proximate to the upper end of the second base portion ramp when in the second position.

19. The track set according to claim 16, wherein the housing is adjacent to both the first base portion and the second base portion when the second base portion is positioned in the aligned position.

* * * * *